United States Patent [19]

Fischer et al.

[11] 4,269,402

[45] May 26, 1981

[54] FOLDING APPARATUS

[75] Inventors: Rudolf Fischer, Lu-Oggersheim; Karl-Heinz Hartmann, Lambsheim, both of Fed. Rep. of Germany

[73] Assignee: Firma Albert-Frankenthal AG, Frankenthal, Fed. Rep. of Germany

[21] Appl. No.: 954,148

[22] Filed: Oct. 24, 1978

[30] Foreign Application Priority Data

Nov. 14, 1977 [DE] Fed. Rep. of Germany ..... 2750792

[51] Int. Cl.[3] ..... B65H 45/18; B41F 13/24

[52] U.S. Cl. ..... 493/437; 101/227; 101/232; 271/202

[58] Field of Search ..... 101/232, 227; 270/64, 270/65, 72, 83, 85; 271/243, 245, 246, 270, 202, 203, 182

[56] References Cited

U.S. PATENT DOCUMENTS

| | | | |
|---|---|---|---|
| 2,172,361 | 9/1939 | Clauberg | 270/83 |
| 3,206,191 | 9/1965 | Hantscho | 270/85 |
| 3,685,823 | 8/1972 | Chambon | 271/270 |
| 3,994,221 | 11/1976 | Littleton | 271/202 |

*Primary Examiner*—Robert E. Bagwill
*Assistant Examiner*—A. Heinz
*Attorney, Agent, or Firm*—Allison C. Collard; Thomas A. Galgano

[57] ABSTRACT

A folding apparatus for rotary roller printing presses, having at least one collecting or crosswise folder, positioned behind which there is at least one sword folder composed of a folding sword interacting with a pair of folding cylinders, the folded material being conveyed to the sword folder via a belt guide having upper and lower belts and, in the region of the folding sword, passing positioned limit stops for the folded material. The belt guide has at least two strands positioned one behind the other and being driven at opposingly stepped speeds, with the faster-running strand on the collecting or crosswise folder side, having a run-out groove opening wedge-shapedly, beyond which least one locating stop moving at the speed of the slower-running strand, on the sword folder side, is positioned, its path at least partly overlapping with the feeding-in region of the equally fast belt guide strand.

10 Claims, 1 Drawing Figure

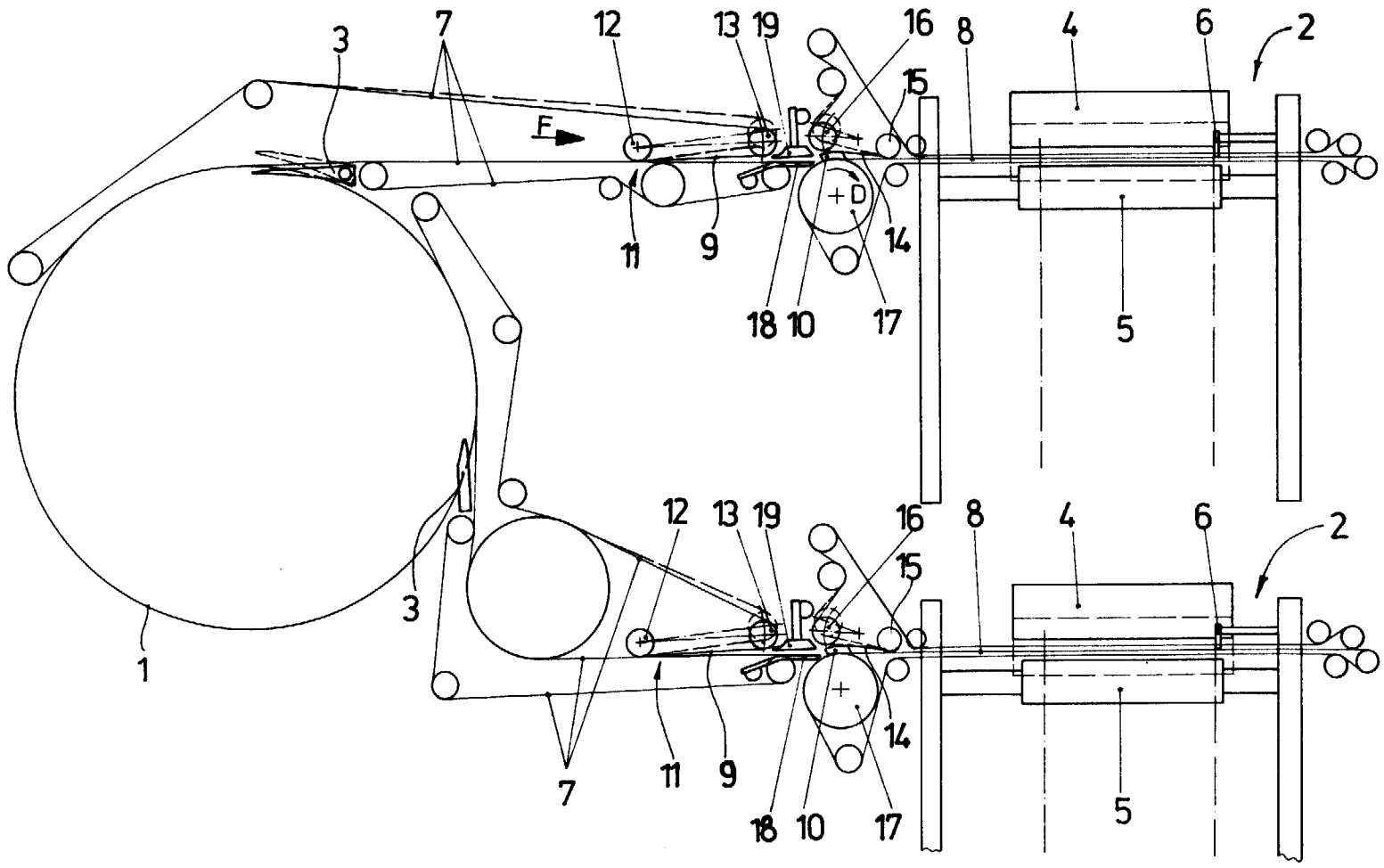
2
6
4
5
8
16
15
14
17
10
18
19
13
9
12
11
F
7
3
1

FOLDING APPARATUS

The invention relates to a folding apparatus for rotary roller printing presses. More particularly, it relates to such a folding apparatus which has at least one collecting or crosswise folder, positioned behind which there is at least one sword folder comprising a folding sword interacting with a pair of folding cylinders, the folded material being conveyed to the sword folder via a belt guide having upper and lower belts and, in the region of the folding sword, passing positioned limit stops for the folded material.

In known arrangements of this type the belt guide between the collecting or crosswise folder and the sword folder positioned behind is in each case constructed as a single component. The running speed of the belt guide, and thus also the speed of conveyance of the products moved by it, corresponds therefore, along the whole length of the belt guide, to the full peripheral speed of the last member of the collecting or crosswise folder. The products fed to the sword folder at this speed of conveyance must therefore be stopped dead at the aforementioned limit stops, from their full speed of conveyance and in a single-stage braking action a relatively large amount of energy is uncontrollably released, so that trouble-free operation can only be expected when the speed of conveyance is relatively low. At increased speeds, on the other hand, damage to the products passed on the sword folder cannot be avoided. Until now this simply had to be accepted, insofar as the running speed of the entire preceding printing press was not curbed, this in turn leading to a reduced output.

Starting from here it is the object of the present invention to avoid the disadvantages of known arrangements by improving a folding apparatus of the aforementioned type in such a way that, despite the necessity of stopping the folded material in the region of the sword folder, high production speeds are possible while at the same time, clean, trouble-free production without damage to the folded material is guaranteed.

The problem is solved in a surprisingly simple way, namely in that the belt guide has at least two strands positioned one behind the other which are driven at opposingly-stepped speeds. The faster-running strand, on the collecting or crosswise folder side, has a run-out groove, opening wedge-shapedly, beyond which at least one locating stop moving at the speed of the slower-running strand, on the sword folder side, is positioned; its path being at least partly overlapping with the feeding-in region of the equally fast belt guide strand.

These measures advantageously result in a multistage braking action, so that despite high starting speed of the belt guide and thus, despite initially high conveyance speed, no damage to the products passed to the sword folder need be feared. In the region of the aforementioned locating stop an exact alignment occurs in each case, simultaneously with the braking action, which with respect to the fold to be passed through the sword folder, results in high accuracy. Since in the region of the run-out groove, the products conveyed by the belt guide are released from constrained contact with the belts of the corresponding belt guide strand, a relatively gentle run-out onto the locating stop positioned behind in each case is guaranteed, thus providing an extremely protective operation. At the same time the crosswise-folded products with their foreward-running fold edges passing onto the locating stop are picked up by the following belt guide strand and carried along, thus eliminating any danger of recoiling. The measures according to the invention accordingly guarantee a mode of operation more gentle and protective than ever thought possible, with simultaneous high production accuracy.

As experiments have shown, a single step-down in speed often proves sufficient in practice. A particularly simple example of the measures outlined above is thus characterized in that the belt guide has two strands positioned one behind the other, one of these being associated with the collecting and crosswise folder and the other with the sword folder. During collective production practically every second product is missing. The gaps resulting thereby between the individual products make it possible to let the sword folder run at half speed, this being desirable with respect to avoiding so-called disturbing whip effects. The same holds for the case when, during double production, the products are in each case alternatingly distributed on two succeeding sword folders. With respect to this it thus proves expedient if the speed of the belt guide strand on the sword folder side is reduced by a maximum of 50% as opposed to the speed of the preceding belt guide strand, which runs at the peripheral speed of the collecting or crosswise folder. These measures guarantee trouble-free operation, without adjustment, for the working of all sizes of product in question and thus allow extremely simple design of the printer and extremely simple operation. Particularly preferable here is an exact 50% reduction in the speed, which advantageously results in two equal braking stages.

As a further development of the measures outlined above, the length of the run-out groove from the groove tip to the locating stop behind should correspond at least to the maximum length of product which can be worked. This means that, without adjustment, the products are released in the region of the run-out groove from constrained contact and thus pass relatively gently onto the succeeding locating stop. This measure is thus also effective especially with simple constructions.

A further advantageous embodiment of the measures outlined above can consist in the aperture angle of the runout groove being adjustable. In this way adaptation by simple means to the respective running speed, size of product, thickness of product and paper quality is assured, so guaranteeing on the one hand a safe stopping motion at the locating stop and on the other, prevention of an unnecessarily hard impact.

A further advantageous measure can consist in there being, associated with the run-out groove, an adjustable lead-in groove of the successive belt guide strand. These measures guarantee, in an advantageous way, a further, individual adjustment so that the products passing onto the locating stop are in any case gently picked up and prevented from rebounding.

A simple and therefore particularly preferred embodiment for effecting the previously-mentioned groove adjustment possibilities can consist in the upper belt set of the two belt guide strands being passed, in the region of the run-out or lead-in groove, over two belt rollers, of these the roller provided in the region of the groove tip being stationary and the roller provided in the aperture region of the respective groove preferably being supported to swing about the axis of the stationary belt roller. These measures clearly guarantee an extremely simple and thus economical construction design and at the same time, easy operation.

A further particularly advantageous embodiment of the measures outlined above can consist in that in the region between the run-out groove and a following lead-in groove, and at the level of the lower belt set of the belt guide, there are lower sheet guides provided and above these, upper sheet guides. These measures advantageously guarantee, without toothing of the two belt guide sets, a clean bridging, and thus at the same time guarantee that the sword folder together with its associated belt guide strand can be laterally adjusted, this being particularly desirable with regard to the working of different product sizes since the fold to be made by the sword folder usually has to lie in the middle of the product to be folded. It can prove particularly expedient if the upper sheet guide can be vertically adjusted, so that when working with different products possibilities of deviation can with certainty be eliminated.

Another measure which is a particularly advantageous further development of the measures outlined above can consist in the locating stop being in each case firmly positioned on a rear belt roller, which preferably takes up the lower belt set of each belt guide strand, running in each case at the same speed, and the locating stop being provided with recesses for the belts of the corresponding belt set. These measures result in extremely simple coupling between the locating stop and the corresponding belt guide strand. Additional measures for supporting and driving the locating stop are thus rendered completely unnecessary. These measures thus prove extremely space-saving and at the same time, extremely economical. As a rule, one locating stop per belt roller suffices, which results in a particularly compact model. Since the belt roller taking up the locating stop can be adjusted in peripheral direction while the machine is running, the moment when the locating stop starts to operate, i.e., the moment of impingement of the products to be slowed down, can be exactly set.

Further features and advantages of the invention are shown by the following description of an example by means of drawing, together with the claims.

The drawing shows a view of a preferred embodiment of the invention by means of a folding apparatus provided with two sword folders positioned behind a crosswise folder and being alternately in action, the folding apparatus being represented schematically.

In the drawing, a folding blade cylinder 1 is provided with folding blades of familiar construction and not shown in more detail, of a crosswise folder, behind which two sword folders, each generally designated by reference numeral 2, are positioned. Sword folders 2 are alternatingly fed with the products to be provided here with a third longitudinal fold. For conveying the folded material from folding blade cylinder 1 of the crosswise folder to the two following sword folders 2, belt guides are provided, where in each case an upper and a lower set of belts arranged next to each other work in combination so that products inserted between the upper and the lower belts are picked up on both sides and thus compulsorily carried along. The folding blades of folding blade cylinder 1 hold the products folded crosswise here by their fold edges and apply them, fold edges preceding, to the belt guides.

To effect a clean transfer of the products from the folding blades to the belt guides, transfer channels formed by controlled lifting tongues 3 are provided, which guide the products to be taken from the folding blade cylinder 1 between the upper and lower belts of the respective neighboring belt guide.

The lifting tongues 3 are so controlled that only every second product is picked up in each case, so that gaps occur between the individual products to thereby make it possible to lengthen the cycle time of the sword folder 2 correspondingly. Sword folders 2 each include a folding sword 4 which interacts with a pair of folding cylinders 5 positioned underneath the respective folding sword 4. During the folding process, the folding sword 4 is sunk between the belts of the belt guide pushing the product underneath downwards out of the plane of the belts and applying it to the folding cylinders 5 positioned underneath. The products leaving the folding cylinders 5 fall into a bucket wheel which puts out the finished products. The to and fro working action of the folding sword 4 necessitates stopping of the products supplied in each case. For this reason, the belt guide passes stationarily positioned limit stops 6 provided in the region of the sword folder 2, onto which limit stops the products conveyed by the belt guide impinge and are stopped. In order to reduce the impact and thus to prevent any damage to the products passing onto the limit stops 6 the belt guide is divided into several strands, these being driven at opposingly stepped speeds in the direction of conveyance indicated by the arrow F. In this way a several-stage braking action is advantageously effected, so that the forces being released per stage are easily controllable and no damage to the products need be feared. In the particularly preferred embodiment shown belt guides are provided which each have two strands 7 and 8 arranged one behind the other, one of these being associated with the crosswise folder indicated here by its folding blade cylinder 1 and the other, in each case, with a succeeding sword folder 2. Strand 7 of the belt guide, being associated with the crosswise folder, runs at the peripheral speed of the folding blade cylinder 1. The speed of strand 8, positioned behind strand 7 in each case, should, according to a particularly preferred embodiment, be reduced by 50% as opposed to the speed of the preceding strand 7. During production where two belt guides are alternatingly supplied, as in the present case, or during collective production, where every second product is also missing, a 50% reduction in the speed of the slower-running belt guide strand results in these gaps in the region of this strand disappearing, so that without any alteration to the construction or setup of the machine, practically every size of product in question can be worked, this resulting in simple operation but nevertheless guaranteeing high versatility. Other speed steps can, under certain circumstances, be used if the enlargement of the gaps resulting during the working of smaller formats is to be compensated for.

At the front end, in the direction of conveyance, of the belt guide strand 7, on the crosswise folder side, a run-out groove 9 opening wedge-shapedly in the direction of conveyance is provided, as can be clearly seen in the drawing. In this way it is ascertained that in the region of transfer from the faster-running to the succeeding slower-running strand of the belt guide the products are released from the constraint of the conveyance belts, which simplifies the transfer. A locating stop 10 is positioned after each of the run-out grooves 9, which locating stop moves, at least in the plane of the product path, at the speed of the slower-running belt guide strand, here in each case the web 8 on the sword folder side. In this way, the products discharged via the run-out groove 9 are slowed exactly to the speed of the successively-positioned, slower-running web. At the same time the products arriving at and impinging on the locating stops 10 are cleanly aligned, which results in high accuracy of production. The fact that in the region of the run-out groove 9 there is no longer any constrained product conveyance ensures that the products leaving the faster-running strand 7 in each case pass gently onto the respective succeeding locating stop 10. The length of the run-out groove 9, i.e., the distance between the groove tip, indicated by 11, and the succeeding locating stop 10 corresponds expediently to at least the maximum workable product length, preferably with an additional fixed distance allowance. This means that without adjustment to the machine, all workable sizes of format are released reliably from constraint in the region of the run-out groove 9, thus ensuring a trouble-proof transfer.

The aperture angle of the run-out groove 9 is, as indicated in the drawing by broken lines, advantageously constructed to be adjustable, so that its function can be exactly adjusted for every desired running speed, size of product, thickness of product, quality of paper, etc. In the particularly preferred embodiment shown such an adjustability is effected in that the belts of the respective upper belt set of belt guide strand 7 are passed in the region of the run-out groove 9 over a stationary belt roller 12 positioned in the region of the groove tip 11 and over a belt roller 13 positioned swingably in the region of the rear strand end, with belt roller 13 being preferably supported to swing about the axis of the stationary belt roller 12. By swiveling the belt roller 13, the aperture of the corresponding run-out groove 9 can be adjusted to any desired size.

In the example shown, as can be clearly seen from the drawing, each slower-running belt 8 of the belt guides is provided at the start with a lead-in groove 14, which in many cases can further simplify the transfer. The path of locating stop 10 reaches preferably into the corresponding lead-in groove 14 in such a way that the products passing onto the corresponding locating stop 10 are immediately picked up again and any rebounding is thus avoided. In this way, subsequent skewing or lateral dislocations of the products are effectively prevented, which advantageously results in an exact folding process in the region of the following sword folder. In order to ensure that the products are carried along without any problem also under varying production conditions, for example, varying sizes of products, product thickness, quality of paper, etc., the aperture angle of lead-in groove 14 is also expediently constructed to be adjustable. In the example shown, each upper belt set of the corresponding belt guide strand 8 is passed, in the region of its rear end with respect to the direction of conveyance, over two belt rollers 15 and 16, where the belt roller 15 in the region of the groove tip is held stationary and the belt roller 16 in the region of the rear strand end is swingably mounted, as shown in the drawing by broken lines. By swinging this belt roller 16, it can be seen how the aperture of the lead-in groove 14 can be adjusted so that the ingoing products are immediately constrainedly picked up and any recoiling from the corresponding locating stop 10 is prevented.

The locating stops 10 can be accommodated with their ends or an associated crank gear which for its part is coupled in driving operation with the corresponding belt guide strand 8, having the same speed. In the particularly preferred embodiment shown, the locating stop 10 is firmly positioned on a belt roller 17 bordering the lead-in groove 14 underneath and taking up the lower belt set of each slower-running strand 8 of the belt guide, which clearly results in an extremely simple and space-saving construction of drive and support. To ensure that the belts run cleanly, the locating stop 10 is provided with recesses for the belts of the belt set passed over the belt roller 17. The number of locating stops 10 is in accordance with the diameter of the belt roller 17. In the example shown, the belt roller 17 is so measured that its periphery corresponds to at least the maximum workable size of product. Such cases have the advantage of one locating stop 10 sufficing, which expediently results in a very compact design. In order to effect an exact fine adjustment of the locating stop 10, the belt rollers, each being provided with one locating stop 10, can be expediently adjusted forwards or backwards in the peripheral direction while the machine is running. This can be done by means of a differential gearing or simply with the help of axially movable, obliquely-toothed pinions. These measures accordingly guarantee that the locating stops 10 are in the plane of the path of arriving products exactly at the desired moment.

Bridging between the strands 7, being arranged next to each other, and 8 of the belt guides there are lower and upper product sheet guides, 18 and 19 respectively, as can be clearly seen from the drawing. The lower sheet guides 18 are fixed at the level of the lower belt set in each case. The upper sheet guides 19 are expediently designed to be vertically adjustable, so that the inside width of the passage so limited can be adjusted to the conditions of individual cases. These sheet guides are first and foremost of necessity when the sword folders can be displaced laterally and there can be no cogging of the herewith coupled strand 8 with the preceding strand 7. This is normally the case in machines which work products of differing width, since the fold to be formed by the sword folder should normally lie in the middle.

The make-up of the arrangement according to the invention can be clearly gathered from the preceding explanations. The mode of working of this arrangement is extremely simple. During normal operation strand 7 of the belt guides runs at the peripheral speed of the folding blade cylinder 1. Strand 8 of the belt guides, succeeding strand 7 in each case, should only run at half-speed. The products passed to web 7 by means of the lifting tongues 3 are discharged in the region of the respective run-out groove 9, there being no longer any constrained conveyance on account of the groove aperture.

The forward edges of the products leaving strand 7 pass onto the succeeding locating stop 10 and are there slowed down and at the same time, aligned. At the same time, these products are picked up by belt guide strand 8, running at the same speed as the locating stop 10, and thus passed under constraint, at reduced speed, under folding sword 4, where final braking occurs in the region of the stationary limit stops 6. On its downward stroke folding sword 4 pushes the product underneath out of the running belt guide and guides it between the folding rollers 5 underneath. These convey the product further downwards, so completing the desired longitudinal fold. The finished products then fall into a bucket wheel and, as already indicated above, are put out. Due to the two belt guides being alternately supplied, gaps occur between the individual products, which gaps are practically closed during the multistage braking process according to the invention.

In the preceding description, a particularly preferred embodiment of the invention has been explained in detail; this, however, should not imply any limitation. The expert has much rather a series of possibilities at his disposal in order to adapt the general thinking of the invention to the individual case. It would thus be quite conceivable to position more than two belt guides behind each other, in which case a delay device of the nature illustrated above would have to be provided between each two strands.

Thus, while only one embodiment of the present invention has been shown and described, it will be obvious to those persons of ordinary skill in the art, that many changes and modifications may be made thereunto without departing from the spirit and scope of the invention.

What is claimed is:

1. In a folding apparatus for rotary roller printing presses which includes at least one collecting folder, at least one sword folder positioned behind said collecting folder which includes a folding sword interacting with a pair of folding cylinders, a belt guide having upper and lower belts for conveying folded material from said collecting folder to said at least one sword folder, and a fixed limit stop positioned adjacent to said folding sword which said belt guide passes, the improvement comprising:

said belt guide having at least two successively arranged belt strands successively driven at different stepped speeds, said belt strands comprising a faster-running first strand and a slower-running second strand, said first strand having a discharge end which defines a run-out groove opening wedge-shapedly from a groove tip, and said second strand having a feeding-in region disposed proximate to said discharge end of said first strand, said first and second strands each having an upper belt and a lower belt and two belt rollers over which said upper belt of each strand passes disposed in the region of the respective run-out and lead-in grooves of said strands, said two belt rollers associated with each of said strands including a first belt roller mounted in fixed position adjacent to said groove tip of its associated opening and a second roller supported for pivotable movement about the axis of said first roller disposed adjacent to the end of said associated opening remote from said groove tip thereof; and at least one locating stop positioned between said discharge end of said first strand and said feeding-in region of said second strand, said stop moving at a speed equal to that of said second strand and having a path of movement which at least partly overlaps said feeding-in region of said second strand.

2. The folding apparatus according to claim 1, wherein the length of said run-out groove from said groove tip to said locating stop corresponds at least to the maximum length of product which can be worked.

3. The folding apparatus according to claim 1, wherein the angle of opening of said run-out groove is adjustable.

4. The folding apparatus according to claim 1, wherein said feeding-in region of said second strand has an adjustable lead-in groove ending in a groove tip.

5. The folding apparatus according to claim 1, wherein there is only one locating stop between said first and second strands.

6. The folding apparatus according to claim 1, wherein, at least in the region between said lead-in groove of said second strand, and said run-out groove of said preceding first strand and at the level of the lower belts of each of said strands, there are lower sheet guides provided and above these, upper sheet guides.

7. The folding apparatus according to claim 6, wherein said upper sheet guides are vertically adjustable.

8. The folding apparatus according to claim 1, wherein said locating stop is positioned on a rear belt roller over which said lower belt of said second strand runs so as to effect rotation of said stop at the same speed as said belt, said locating stop being provided with recesses for the receipt of said lower belt.

9. The folding apparatus according to claim 1, wherein said first strand has a feeding-in end disposed adjacent to said collecting folder for receiving products therefrom and wherein said second strand has a discharge end disposed adjacent to said sword folder for transferring products thereto.

10. The folding apparatus according to claim 9, wherein said first strand runs at the peripheral speed of said collecting folder, and said second strand runs at a peripheral speed reduced by a maximum of 50% relative to said first strand.

* * * * *